US010997927B2

(12) United States Patent
Kang et al.

(10) Patent No.: US 10,997,927 B2
(45) Date of Patent: May 4, 2021

(54) ELECTRONIC APPARATUS AND CONTROLLING METHOD THEREOF

(71) Applicant: Samsung Electronics Co., Ltd., Suwon-si (KR)

(72) Inventors: Jinsung Kang, Suwon-si (KR); Kyuheon Lee, Suwon-si (KR); Sunghwan Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/713,865

(22) Filed: Dec. 13, 2019

(65) Prior Publication Data

US 2020/0202800 A1 Jun. 25, 2020

(30) Foreign Application Priority Data

Dec. 24, 2018 (KR) ..... 10-2018-0168737

(51) Int. Cl.
*G09G 3/34* (2006.01)

(52) U.S. Cl.
CPC ... *G09G 3/3406* (2013.01); *G09G 2320/0233* (2013.01); *G09G 2320/0626* (2013.01)

(58) Field of Classification Search
CPC combination set(s) only.
See application file for complete search history.

(56) References Cited

U.S. PATENT DOCUMENTS 8,378,596 B2 2/2013 Ayres
8,884,939 B2 11/2014 Barnhoefer et al.
9,412,296 B2 8/2016 Mirski-Fitton et al.
9,892,689 B2 2/2018 Kang et al.
2007/0126727 A1 6/2007 Chiang
2010/0194725 A1 8/2010 Yoshida et al.
2015/0070337 A1* 3/2015 Bell ..... G09G 3/007 345/207
2017/0221450 A1 8/2017 Kim et al.
2018/0090104 A1 3/2018 Song et al.
2018/0190240 A1 7/2018 Ropo et al.

FOREIGN PATENT DOCUMENTS

JP 9-145468 6/1997
KR 20-1999-0012838 4/1999

OTHER PUBLICATIONS

Extended Europeans Search Report dated May 18, 2020 in European Patent Application 19219093.2.

* cited by examiner

*Primary Examiner* — Deeprose Subedi
(74) *Attorney, Agent, or Firm* — Staas & Halsey LLP

(57) ABSTRACT

An electronic apparatus includes a sensor configured to obtain illuminance values, a display, at least one processor, and at least one memory, and the memory stores instructions set for the processor to obtain illuminance values for a predetermined period by controlling the sensor, adjust at least one brightness change threshold value to change brightness of the display in accordance with the obtained illuminance values for the predetermined period and change the brightness of the display using the adjusted brightness change threshold value. There may be other various embodiments.

17 Claims, 10 Drawing Sheets

FIG. 3

CHANGE BRIGHTNESS ADJUST THRESHOLD VALUE | CHANGE BRIGHTNESS ADJUST THRESHOLD VALUE | CHANGE BRIGHTNESS ADJUST THRESHOLD VALUE | CHANGE BRIGHTNESS ADJUST THRESHOLD VALUE

FIRST PERIOD(310) → SECOND PERIOD(320) → THIRD PERIOD(330) → . . . → t

| TIME | ILLUMINANCE (Lux) |
|---|---|
| : | : |
| 1/3 13:00 | 200 |
| : | : |
| 1/20 16:00 | 130 |
| 1/21 16:30 | 125 |
| : | : |
| 2/20 20:00 | 90 |
| 2/25 20:30 | 100 |
| : | : |
| 3/31 24:00 | 50 |

| | |
|---|---|
| MAXIMUM VALUE | 200 |
| MINIMUM VALUE | 50 |

| | |
|---|---|
| FIRST BRIGHTNESS CHANGE THRESHOLD VALUE | 55 |
| SECOND BRIGHTNESS CHANGE THRESHOLD VALUE | 60 |
| : | : |
| NTH BRIGHTNESS CHANGE THRESHOLD VALUE | 195 |

| TIME | ILLUMINANCE (Lux) |
|---|---|
| : | : |
| 4/4 13:00 | 230 |
| : | : |
| 4/20 16:00 | 150 |
| 4/21 16:30 | 110 |
| : | : |
| 5/15 20:00 | 70 |
| 5/20 20:30 | 80 |
| : | : |
| 6/31 24:00 | 60 |

| | |
|---|---|
| MAXIMUM VALUE | 230 |
| MINIMUM VALUE | 60 |

| | |
|---|---|
| FIRST BRIGHTNESS CHANGE THRESHOLD VALUE | 65 |
| SECOND BRIGHTNESS CHANGE THRESHOLD VALUE | 70 |
| : | : |
| NTH BRIGHTNESS CHANGE THRESHOLD VALUE | 215 |

| TIME | ILLUMINANCE (Lux) |
|---|---|
| : | : |
| 7/3 13:00 | 180 |
| : | : |
| 7/18 16:00 | 110 |
| 7/25 16:30 | 90 |
| : | : |
| 8/10 20:00 | 50 |
| 8/20 20:30 | 40 |
| : | : |
| 9/30 24:00 | 30 |

| | |
|---|---|
| MAXIMUM VALUE | 180 |
| MINIMUM VALUE | 30 |

| | |
|---|---|
| FIRST BRIGHTNESS CHANGE THRESHOLD VALUE | 35 |
| SECOND BRIGHTNESS CHANGE THRESHOLD VALUE | 40 |
| : | : |
| NTH BRIGHTNESS CHANGE THRESHOLD VALUE | 175 |

FIG. 5
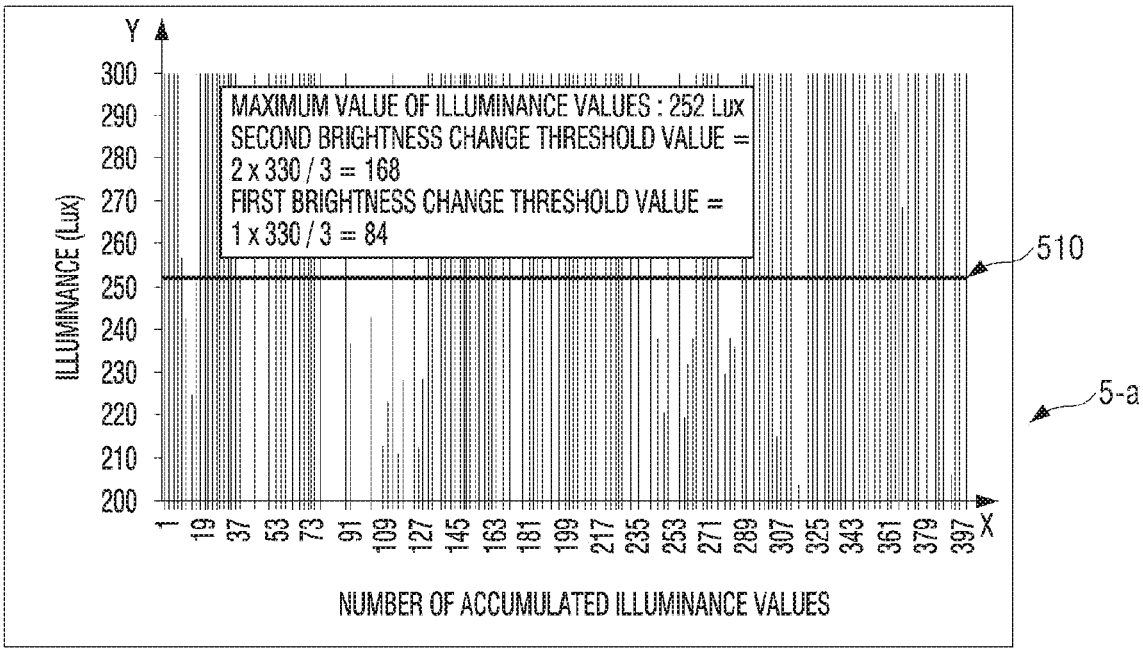
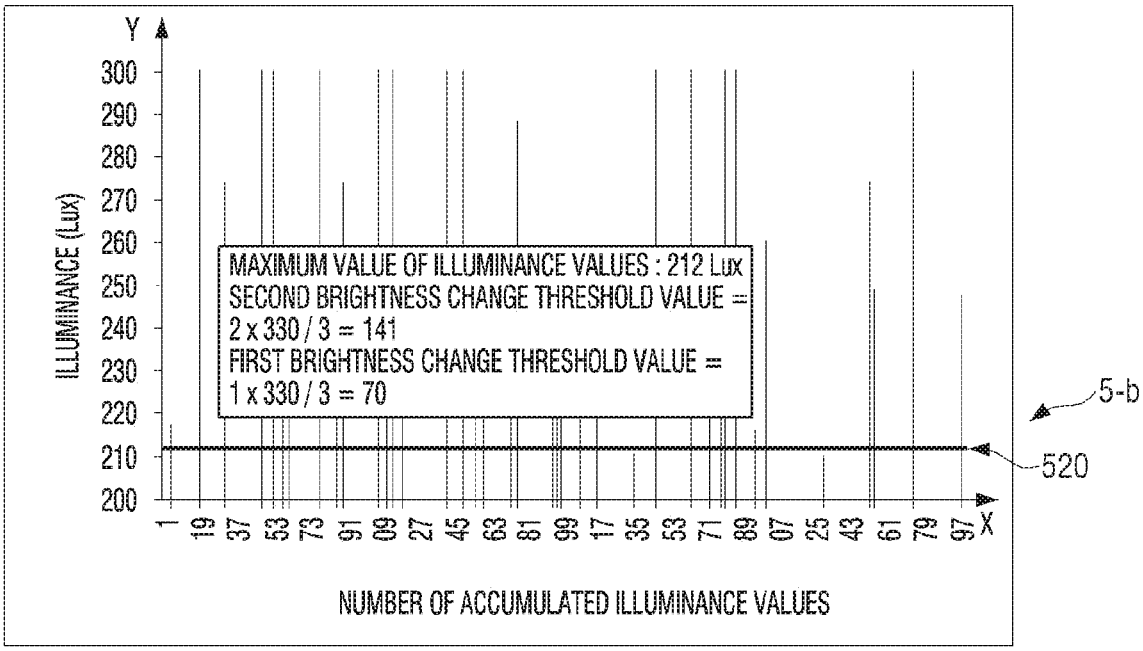

FIG. 7
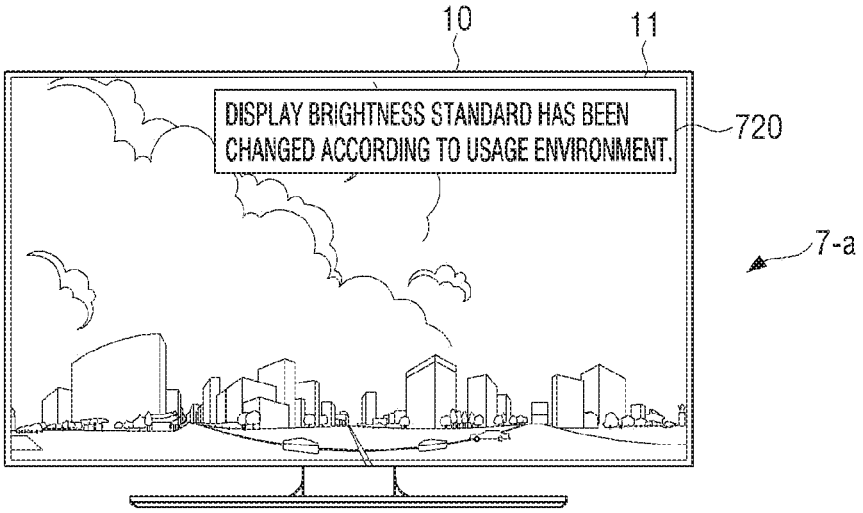
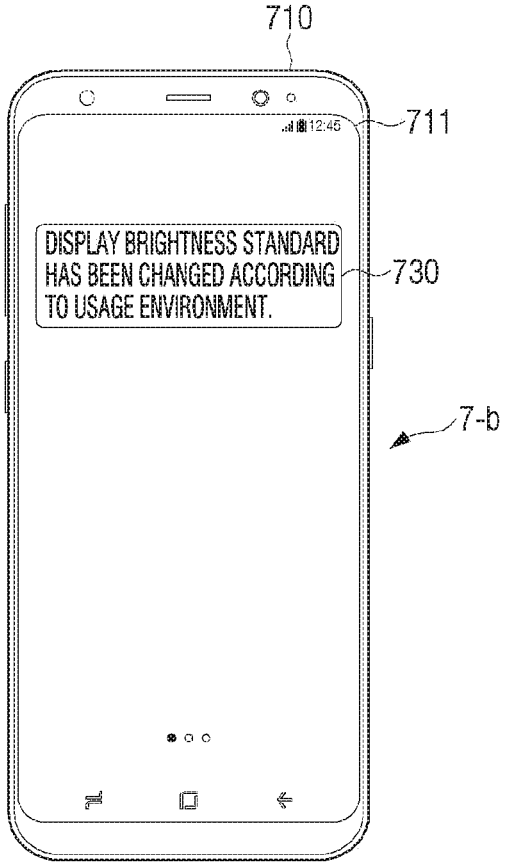

ELECTRONIC APPARATUS AND CONTROLLING METHOD THEREOF

CROSS-REFERENCE TO RELATED APPLICATIONS

This application claims priority from Korean Patent Application No. 10-2018-0168737, filed on Dec. 24, 2018 in the Korean Intellectual Property Office, the disclosure of which is incorporated herein by reference in its entirety.

BACKGROUND

1. Field

Apparatuses and methods consistent with exemplary embodiment of the present disclosure relate to a method of changing the brightness of a display using brightness information of a peripheral area.

2. Description of the Related Art

An electronic apparatus including a display may receive a signal transmitted from outside and output a content on a display, or may output a content on a display using prestored data.

Recently, an electronic apparatus may obtain an illuminance value in an area where the display apparatus is located and change the brightness of the display outputting a content. For instance, the electronic apparatus may adjust the brightness of the display according to the illuminance value which is obtained using database where matching information between the illuminance value and the brightness of the display is stored.

SUMMARY

An electronic apparatus may adjust the brightness of a display using an illuminance value of a peripheral area, allowing a user to view a content easily. However, in a situation where the environment of the display is not always the same, adjusting the brightness of the display according to a fixed criterion may cause inconvenience to the user since the user would watch the content at brightness not suitable for the viewing environment.

An aspect of the embodiments relates to providing a display apparatus including a sensor configured to obtain illuminance values, a display, at least one processor, and at least one memory, and the memory stores instructions set for the processor to obtain illuminance values for a predetermined period by controlling the sensor, adjust at least one brightness change threshold value to change brightness of the display in accordance with the obtained illuminance values for the predetermined period and change the brightness of the display using the adjusted brightness change threshold value.

The instructions may be set for the processor to adjust the brightness change threshold value using the illuminance values that are obtained while outputting a content using the display.

The instructions may be set for the processor to provide a user interface for changing the predetermined period during which the illuminance values are obtained by controlling the display.

The instructions may be set for the processor to obtain a maximum value of the illuminance values and a minimum value of the illuminance values using the obtained illuminance values, and adjust the brightness change threshold value using the maximum value of the illuminance values and the minimum value of the illuminance values.

The instructions may be set for the processor to determine a maximum value of the illuminance values using illuminance values of which frequency is equal to or greater than a predetermined value from among the obtained illuminance values.

The instructions may be set for the processor to obtain an average value of the obtained illuminance values and determine the average value as a maximum value of the illuminance values.

The instructions may be set for the processor to adjust a brightness change threshold value by evenly dividing a difference between the maximum value of the illuminance values and the minimum value of the illuminance values by a value generated using a number of brightness change threshold values.

The instructions may be set for the processor, based on identifying that a location of the electronic apparatus is changed, to re-start a period for obtaining and storing illuminance values.

The instructions may be set for the processor to output a notification informing that the display is controlled using the adjusted brightness change threshold value.

An aspect of the embodiments relates to a server including a data acquiring unit configured to obtain illuminance values that are accumulated for a predetermined period from an external apparatus, a data processor configured to adjust at least one brightness change threshold value to change brightness of a display in accordance with the accumulated illuminance values, and a data output unit configured to transmit the adjusted brightness change threshold value to an external apparatus.

An aspect of the embodiments relates to a controlling method including obtaining illuminance values for a predetermined period, adjusting at least one brightness change threshold value to change brightness of a display in accordance with the obtained illuminance values for the predetermined period, and changing the brightness of the display using the adjusted brightness change threshold value.

The method may include adjusting the brightness change threshold value using the illuminance values that are obtained while outputting a content using the display.

The method may include providing a user interface for changing the predetermined period during which the illuminance values are obtained.

The method may include obtaining a maximum value of the illuminance values and a minimum value of the illuminance values using the obtained illuminance values, and adjusting the brightness change threshold value using the maximum value of the illuminance values and the minimum value of the illuminance values.

The method may include determining a maximum value of the illuminance values using illuminance values of which frequency is equal to or greater than a predetermined value from among the obtained illuminance values.

The method may include obtaining an average value of the obtained illuminance values and determining the average value as a maximum value of the illuminance values.

The method may include adjusting a brightness change threshold value by evenly dividing a difference between the maximum value of the illuminance values and the minimum value of the illuminance values by a value generated using a number of brightness change threshold values.

The method may include, based on identifying that a location of the electronic apparatus is changed, re-starting a period for obtaining and storing illuminance values.

The method may include outputting a notification informing that the display is controlled using the adjusted brightness change threshold value.

An aspect of the embodiments relates to a computer program product including a computer readable recording medium which stores instructions to perform operations of obtaining illuminance values for a predetermined period, adjusting at least one brightness change threshold value to change brightness of a display in accordance with the obtained illuminance values for the predetermined period, and changing the brightness of the display using the adjusted brightness change threshold value.

According to an embodiment, an electronic apparatus may adjust a brightness change threshold value of a display using obtained illuminance values.

According to an embodiment, an electronic apparatus may provide a user interface for setting a period for obtaining illuminance values to adjust a brightness change threshold value of a display.

According to an embodiment, an electronic apparatus may obtain a maximum value of illuminance values and a minimum value of illuminance values using the obtained illuminance values and adjust a brightness change threshold value using the maximum values of the illuminance values and the minimum value of the illuminance values.

BRIEF DESCRIPTION OF THE DRAWINGS

The above and/or other aspects of the present inventive concept will be more apparent by describing certain exemplary embodiments of the present inventive concept with reference to the accompanying drawings, in which:

FIG. 3 is a view provided to explain a situation sequentially where an electronic apparatus obtains a brightness change threshold value by obtaining an illuminance value according to an embodiment;

FIG. 5 are views provided to explain another embodiment where an electronic apparatus obtains a maximum value and a minimum value of illuminance values according to various embodiments;

FIG. 7 is a view provided to explain a situation where an electronic apparatus displays a notification message informing that a brightness change threshold value has been adjusted according to an embodiment;

DETAILED DESCRIPTION

Figure 1:
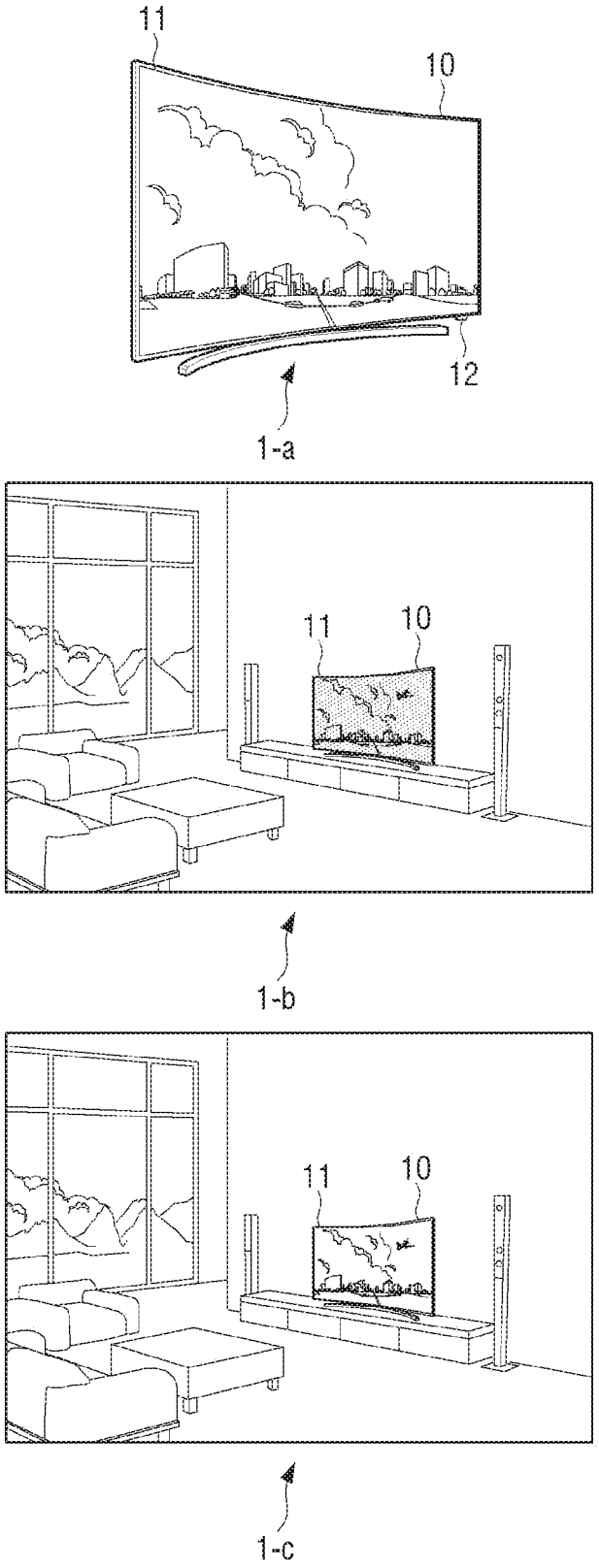
FIG. 1 is a view provided to a situation where an electronic apparatus adjusts a brightness change threshold value and changes the brightness of a display using the adjusted brightness change threshold value according to an embodiment.

Exemplary embodiments of the present disclosure will be described herein below with reference to the accompanying drawings. However, various exemplary embodiments of the present disclosure are not limited to the specific embodiments and should be construed as including modification, equivalent and/or alternative of exemplary embodiments of the present disclosure. In the explanation of the drawings, similar reference numerals are used for similar elements.

The terms "have", "may have", "include", and "may include" used in the exemplary embodiments of the present disclosure indicate the presence of corresponding features (for example, elements such as numerical values, functions, operations, or parts), and do not preclude the presence of additional features.

The terms "A or B," "at least one of A or/and B," or "one or more of A or/and B" used in the exemplary embodiments of the present disclosure include all possible combinations of items enumerated with them. For example, "A or B," "at least one of A and B," or "at least one of A or B" means (1) including at least one A, (2) including at least one B, or (3) including both at least one A and at least one B.

The term such as "first" and "second" used in various exemplary embodiments may modify various elements regardless of an order and/or importance of the corresponding elements, and does not limit the corresponding elements. These terms may be used for the purpose of distinguishing one element from another element. For instance, the first user device and the second user device may represent different user devices regardless of order or importance. For instance, without departing from the scope of rights described in this disclosure, the first component may be referred to as a second component and similarly, the second component may be referred to as the first component.

In addition, the terms "module," "unit," or "part" used in exemplary embodiments indicates an element performing one or more functions or operations, and may be implemented by using hardware or software or a combination of hardware and software. In addition, a plurality of "modules," a plurality of "units," or a plurality of "parts" may be integrated into one or more modules, except that a "module," "unit," or "part needs to be implemented by specific hardware, and may be implemented as one or more processors (not shown).

If it is described that a certain element (e.g., first element) is "operatively or communicatively coupled with/to" or is "connected to" another element (e.g., second element), it should be understood that the certain element may be connected to the other element directly or through still another element (e.g., third element). However, if it is described that an element (e.g., first element) is "directly coupled with/to" or "directly connected to" another element (e.g., second element), it should be understood that there is no intervening element (e.g., third element) between the element and another element.

The terms used in this disclosure are used only to describe certain embodiments and may not be intended to limit the scope of other embodiments. The singular expressions may include plural expressions unless the context clearly dictates otherwise. Terms used herein, including technical or scientific terms, may have the same meaning as commonly understood by one of ordinary skill in the art. The general predefined terms used in this disclosure may be interpreted as having the same or similar meaning as the contextual meanings of the related art and, unless explicitly defined in the present disclosure, shall not be interpreted to have ideally or excessively formal meaning. In some cases, the terms defined in this disclosure cannot be construed to exclude embodiments of the present disclosure.

FIG. 1 is a view provided to a situation where an electronic apparatus adjusts a brightness change threshold value and changes the brightness of a display using the adjusted brightness change threshold value according to an embodiment.

Figure 2:
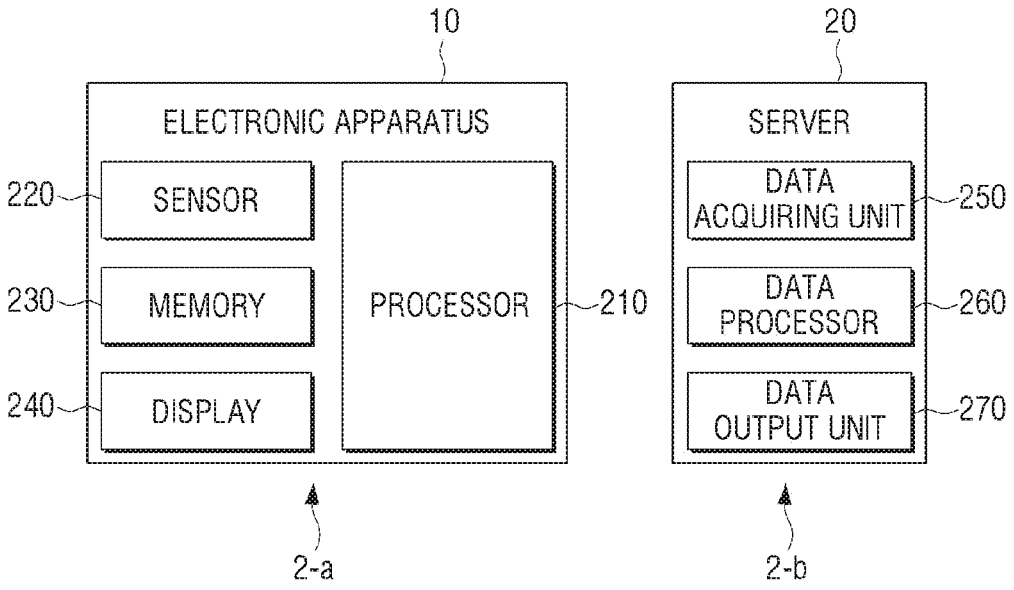
FIG. 2 is a schematic block diagram of an electronic apparatus and a server according to an embodiment.

Referring to 1-A of FIG. 2, an electronic apparatus 10 may be an image display apparatus (e.g., a TV) capable of processing an image signal received from outside and displaying the processed image visually, but is not limited thereto. The electronic apparatus (10) may be implemented as an apparatus including a memory and a processor. For instance, the electronic apparatus 10 may be implemented as various image display apparatuses such as mobile phone, smart phone, tablet PC, digital camera, camcorder, laptop computer, tablet PC, desktop PC, e-book terminal, digital broadcasting terminal, Personal Digital Assistants (PDA), Portable Multimedia Player (PMP), MP3 player, wearable device, and the like.

According to various embodiments, the electronic apparatus 10 may not include a display 11. For instance, the electronic apparatus 10 may be an electronic apparatus which processes an image signal received from outside, and transmits the processed image signal to an external display apparatus using a separate interface (e.g., high definition multimedia interface (HDMI), display port (DP), and the like).

According to an embodiment, the electronic apparatus 10 may obtain an illuminance value of an area where the electronic apparatus 10 is located. For instance, the electronic apparatus 10 may include a sensor 12 for sensing light. The sensor, for example, may include an illuminance sensor. The sensor 12 may obtain an illuminance value by sensing the amount of light at the area where the electronic apparatus 10 is located.

According to an embodiment, the electronic apparatus 10 may change the brightness of the display 11 using the illuminance value which is obtained through the sensor 12. For example, the electronic apparatus 10 may store a look-up table matching a brightness change threshold value and the brightness of the display 11. The electronic apparatus 10 may compare the obtained illuminance value with the bright change threshold value and change the brightness of the display 11 using the brightness of the display matched to the brightness change threshold value.

According to an embodiment, the brightness change threshold value may be a reference value for the electronic apparatus to change the brightness of the display in response to the detected illuminance value.

According to an embodiment, there may be a plurality of brightness change threshold values. For instance, the electronic apparatus 10 may store the first brightness change threshold value, the second brightness change threshold value, and the third brightness change threshold value. The electronic apparatus 10 may identify the first section as a section which is equal to or greater than 0 and less than the first brightness change threshold value, the second section as a section which is equal to or greater than the first brightness change threshold value and less than the second brightness change threshold value, and the third section as a section which is equal to or greater than the second brightness change threshold value and less than the third brightness change threshold value. The electronic apparatus 10 may obtain an illuminance value at the current location and change the brightness of the display according to the section to which the obtained illuminance value belongs.

Referring to 1-B of FIG. 1, the electronic apparatus 10 may change the brightness of the display 11 by applying the illuminance value which is obtained using the sensor 12 to the look-up table matching the brightness change threshold value and the brightness of the display 11.

For instance, the electronic apparatus 10 may identify that the illuminance value of the area where the electronic apparatus 10 is currently located is 200 Lux through the sensor 12. The electronic apparatus 10 may determine the brightness value of the display 11 corresponding to 200 Lux using the look-up table matching the brightness change threshold value and the brightness of the display 11, and change the brightness of the display 11 from 720 nit to 800 nit.

According to an embodiment, the electronic apparatus 10 may obtain an illuminance value for a predetermined period by controlling the sensor 12. The predetermined period, for example, may refer to a period in which illuminance values enough to adjust a brightness change threshold value (e.g., one month to three months) can be accumulated.

According to an embodiment, the electronic apparatus 10 may update the look-up table matching the brightness threshold value and the brightness of the display 11 using the illuminance values obtained during the predetermined period. In other words, the electronic apparatus 10 may adjust at least one brightness change threshold value included in the look-up table using the illuminance values which are obtained during the predetermined period.

For instance, the electronic apparatus 10 may obtain the frequency of the illuminance values input for the predetermined period. The electronic apparatus 10 may determine the illuminance value which is greater than a certain value as the maximum illuminance value of the predetermined period and determine 0 Lux as the minimum illuminance value. The electronic apparatus 10 may adjust the brightness change threshold value by dividing the difference between the maximum illuminance value and the minimum illuminance value by a value obtained by adding 1 to the number of brightness change threshold values.

According to an embodiment, the electronic apparatus 10 may change the brightness of the display based on an adjusted brightness change threshold value. Referring to 1-C of FIG. 1, the electronic apparatus 10 may change the brightness of the display 11 by applying the illuminance values obtained using the sensor 12 to the look-up table where the adjusted brightness change threshold value is applied.

For instance, the electronic apparatus 10 may identify that the illuminance value of the area where the electronic apparatus 10 is located is 200 Lux through the sensor 12. The electronic apparatus 10 may determine the brightness value of the display 11 corresponding to 200 Lux using the look-up table matching the brightness change threshold value and the brightness of the display 11, and change the brightness of the display 11 from 720 nit to 900 nit.

In other words, the electronic apparatus 10 according to an embodiment may output a content to the display 11 at different brightness using the accumulated illuminance values even when the brightness information of the area where the electronic apparatus 10 is located is the same.

According to various embodiments, the electronic apparatus 10 may adjust the brightness change threshold value as described above using the illuminance values which are obtained while outputting contents through the display 11.

According to various embodiments, the electronic apparatus 10 may identify that the location of the electronic apparatus 10 has changed. For instance, a user may register with a server the location of electronic apparatuses which are used in a certain space (e.g., home). Through this, the user may control the electronic apparatuses using the location of the respective electronic apparatuses. In this case, the user may change the location of the electronic apparatus 10 and register the same with the server. Once the electronic apparatus 10 received information regarding the changed location from the server, the electronic apparatus 10 may newly start the period for obtaining and storing the illuminance values and store the illuminance values at a new place.

As such, according to an embodiment, the electronic apparatus 10 may change the brightness of the display 11 adaptively according to a surrounding environment by adjusting the brightness change threshold value of the display 11 in response to the illuminance value of the area where the electronic apparatus 10 is located.

FIG. 2 is a schematic block diagram of an electronic apparatus and a server according to an embodiment.

According to an embodiment, the electronic apparatus 10 may perform the above process described with reference to FIG. 1 by itself, or may perform the above process in association with the server 20.

Referring to 2-A of FIG. 2, the electronic apparatus 10 may include a processor 210, a sensor 220, a memory 230, and a display 240, but is not limited thereto. The electronic apparatus 10 may further include components or may not include some of the components. For instance, the electronic apparatus 10 may further include a communicator capable of communicating with the server 20. In addition, the sensor 220 may include the sensor 12 of FIG. 1. The display 240 may include the display 11 of FIG. 1.

According to an embodiment, the processor 210 may execute a program stored in the memory 230 by controlling the memory 230, and retrieve or store necessary information.

For instance, the processor 210 may obtain illuminance values for a predetermined period by controlling the sensor 220, adjust at least one brightness change threshold value to change the brightness of the display 240 in accordance with the illuminance values obtained for the predetermined period, and change the brightness of display 240 based on the adjusted brightness change threshold value.

According to an embodiment, the sensor 220, for example, may include an illuminance sensor. For instance, the sensor 220 may obtain the illuminance value of the area where the electronic apparatus 10 is located using the illuminance sensor.

According to an embodiment, the memory 230 may store a program for processing and controlling the processor 210, and may store data input to or output from the electronic apparatus 10.

According to various embodiments, the memory 230 may store instructions set to obtain illuminance values for a predetermined period by controlling the sensor 220, adjust at least one brightness change threshold value to change the brightness of the display 240 in accordance with the illuminance values, and change the brightness of the display 240 based on the adjusted brightness change threshold value.

According to an embodiment, the display 240 may display an image, a video and/or an execution screen of an application. If the display 240 is implemented as a touch screen display, the display 240 may be used as an input device as well as an output device. The display 240 may include at least one of a liquid crystal display, a thin film transistor-liquid crystal display, an organic light-emitting diode, a flexible display, a 3D display, and an electrophoretic display.

Referring to 2-B of FIG. 2, the server 20 may include a data acquiring unit 250, a data processor 260 and a data output unit 270.

According to an embodiment, the data acquiring unit 250 may obtain illuminance values from an external apparatus. The data acquiring unit 250 may accumulate and store the obtained illuminance values for a predetermined period. According to various embodiments, the data acquiring unit 250 may obtain illuminance values which are accumulated for a predetermined period.

According to an embodiment, the data processor 260 may adjust at least one brightness change threshold value to change the brightness of the display according to illuminance values using the illuminance values that are obtained for a predetermined period.

According to an embodiment, the data output unit 270 may transmit the adjusted brightness change threshold value to an external apparatus.

FIG. 3 is a view provided to explain a situation sequentially where an electronic apparatus obtains a brightness change threshold value by obtaining an illuminance value according to an embodiment.

Referring to FIG. 3, the electronic apparatus 10 may adjust a bright change threshold value according to a certain period. For instance, the electronic apparatus 10 may adjust a brightness change threshold value in accordance with the first period 310, the second period 320 and the third period 330. Each of the first period 310, the second period 320 and the third period 330 may be, for example, a period where 300~500 illuminance values are accumulated. Alternatively, Each of the first period 310, the second period 320 and the third period 330 may be, for example, a period of 1~2 months.

According to various embodiments, the first period 310, the second period 320 and the third period 330 may be the same period, or each of the periods may be different.

According to an embodiment, the electronic apparatus 10 may obtain illuminance values for the first period 310. For instance, the electronic apparatus 10 may obtain illuminance values from January 1 to March 31. The electronic apparatus 10 may obtain the maximum value of 200 Lux and the minimum value of 50 Lux using the obtained illuminance values. The electronic apparatus 10 may obtain the first brightness change threshold value of 55 Lux, the second brightness change threshold value of 60 Lux, and/or the nth brightness change threshold value of 195 Lux using the obtained maximum value and minimum value. The electronic apparatus 10 may adjust the first brightness change threshold value, the second brightness change threshold value, and/or the nth brightness change threshold value which have been pre-stored, to the obtained brightness change threshold values.

According to an embodiment, the electronic apparatus 10 may obtain illuminance values for the second period 320. For instance, the electronic apparatus 10 may obtain illuminance values from April 1 to June 31. The electronic apparatus 100 may obtain the maximum value of 230 Lux and the minimum value of 60 Lux using the obtained illuminance values. The electronic apparatus 10 may obtain the first brightness change threshold value of 65 Lux, the second brightness change threshold value of 70 Lux, and/or the nth brightness change threshold value of 215 Lux using the obtained maximum value and minimum value. The electronic apparatus 10 may adjust the first brightness change threshold value, the second brightness change threshold value, and/or the nth brightness change threshold value which have been pre-stored, to the obtained brightness change threshold values using the illuminance values obtained during the second period 320.

According to an embodiment, the electronic apparatus 10 may obtain illuminance values for the third period 330. For instance, the electronic apparatus 10 may obtain illuminance values from July 1 to September 30. The electronic apparatus 100 may obtain the maximum value of 180 Lux and the minimum value of 30 Lux using the obtained illuminance values. The electronic apparatus 10 may obtain the first brightness change threshold value of 35 Lux, the second brightness change threshold value of 40 Lux, and/or the nth brightness change threshold value of 175 Lux using the obtained maximum value and minimum value. The electronic apparatus 10 may adjust the first brightness change threshold value, the second brightness change threshold value, and/or the nth brightness change threshold value which have been pre-stored, to the obtained brightness change threshold values using the illuminance values obtained during the second period 330.

Figure 4:
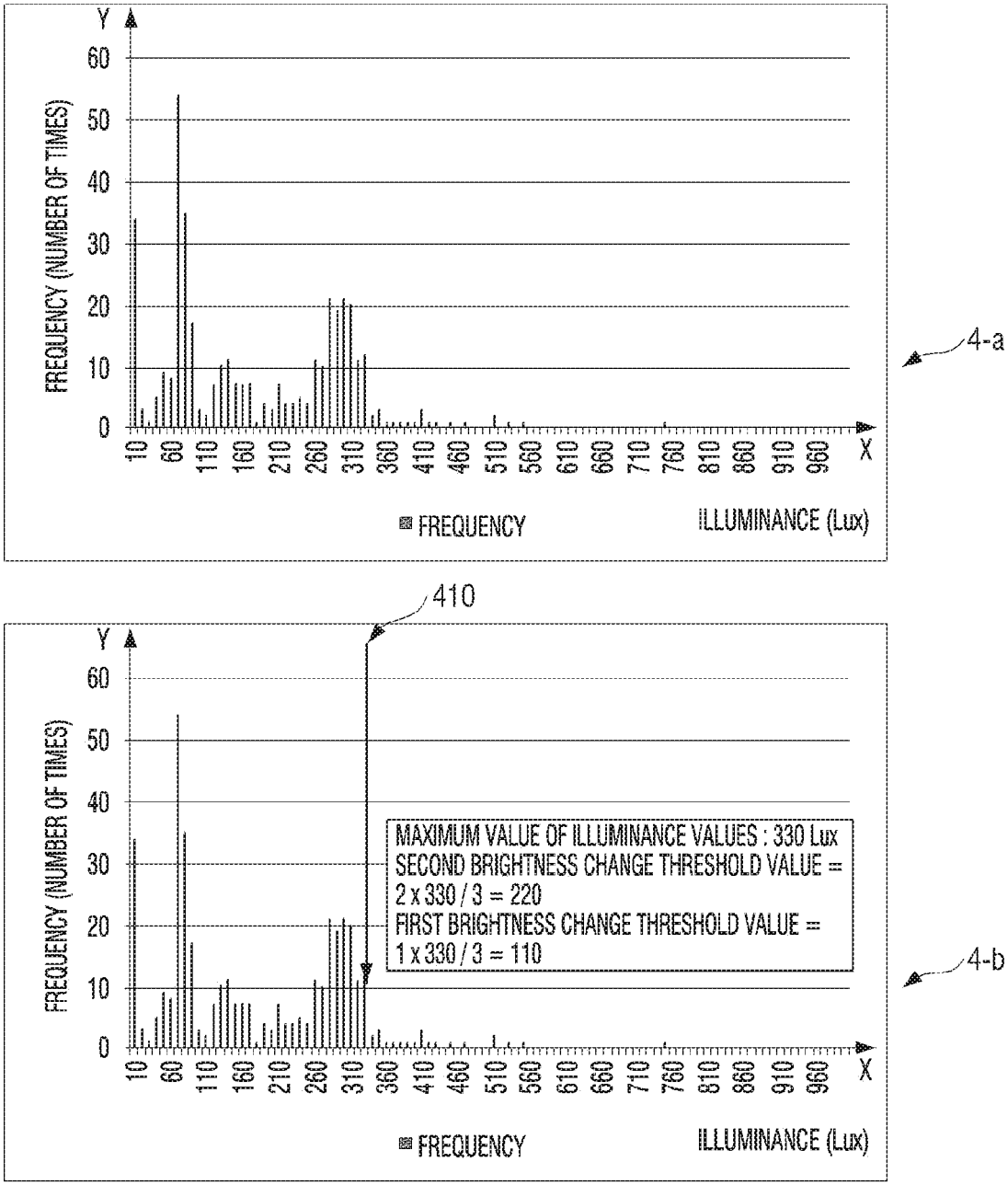
FIG. 4 are views provided to explain an embodiment where an electronic apparatus obtains a maximum value and a minimum value of illuminance values according to an embodiment.

FIG. 4 are views provided to explain an embodiment where an electronic apparatus obtains a maximum value and a minimum value of illuminance values according to an embodiment.

According to an embodiment, the electronic apparatus 10 may obtain the frequency of illuminance values obtained for a predetermined period. For instance, in 4-A of FIG. 4, the X axis may represent illuminance values and the Y axis may represent the frequency. Referring to 4-A of FIG. 4, the electronic apparatus 10 may identify that the illuminance value with the highest frequency is approximately 50~70 Lux, and the highest luminance value is between 750~770 Lux.

According to an embodiment, the electronic apparatus 10 may obtain the maximum value and the minimum value of illuminance values.

Referring to 4-B of FIG. 4, the electronic apparatus 10 may not use the illuminance values whose frequency is less than a certain standard value when obtaining the maximum value and the minimum value of illuminance values. For instance, the electronic apparatus 10 may not use the illuminance values whose frequency is less than 10. For instance, the electronic apparatus 10 may determine 330 Lux (410) as the maximum value of the illuminance values. In addition, the electronic apparatus 10 may determine 0 Lux as the minimum value of the illuminance values.

According to an embodiment, the electronic apparatus 10 may evenly divide the difference between the maximum value and the minimum value of illuminance values using the number of brightness change threshold values to be used. For instance, if there are two brightness change threshold values to be used, the electronic apparatus 10 may evenly divide the difference between the maximum value and the minimum value of illuminance values using 3 which is 2+1.

According to an embodiment, the electronic apparatus 10 may obtain a brightness change threshold value using an evenly-divided value. For instance, if there are two brightness change threshold values used by the electronic apparatus 10, 220 Lux, which is a value obtained by multiplying a value obtained by evenly diving the difference between the maximum value and the minimum value of the illuminance values by 1, can be determined as the first brightness change threshold value. In addition, the electronic apparatus 10 may determine 220 Lux, which is a value obtained by multiplying a value obtained by evenly dividing the difference between the maximum value and the minimum value of the illuminance values by 2, as the second brightness change threshold value.

According to an embodiment, the electronic apparatus 10 may update a look-up table matching a brightness change threshold value and the brightness of a display (e.g., the display 11 of FIG. 1) based on determined at least one brightness change threshold value. For instance, if the illuminance value obtained through a sensor (e.g., the sensor 12 of FIG. 1) is 0~110 Lux, the electronic apparatus 10 may change the brightness value of the display 11 to 400 nit. In addition, if the illuminance value obtained by the sensor 12 is 111~220 Lux, the electronic apparatus 10 may change the brightness value of the display 11 to 600 nit. Further, if the illuminance value obtained through the sensor 12 exceeds 220 Lux, the electronic apparatus 10 may change the brightness value of the display 11 to 700 nit.

According to various embodiments, the electronic apparatus 10 may determine a brightness change threshold value by not evenly dividing the difference between the maximum value and the minimum value of the illuminance values after determining the maximum value of the illuminance values. For instance, the electronic apparatus 10 may divide the difference between the maximum value and the minimum value of the illuminance values and then, give a weighted value to a predetermined threshold value.

FIG. 5 are views provided to explain another embodiment where an electronic apparatus obtains a maximum value and a minimum value of illuminance values according to various embodiments.

According to an embodiment, the electronic apparatus 10 may determine an average value of the illuminance values obtained for a predetermined period as a maximum value. For instance, the X axis in the graphs of 5-A and 5-B of FIG. 5 may represent the number of accumulated illuminance values and the Y axis may represent the illuminance values.

According to an embodiment, the electronic apparatus 10 may obtain a maximum value and a minimum value of the obtained illuminance values.

Referring to FIG. 5-A of FIG. 5, the electronic apparatus 10 may derive the average value of the obtained illuminance values to 252 Lux (510). According to an embodiment, the electronic apparatus 10 may determine the average value of the illuminance values as the maximum value of the illuminance values. In addition, the electronic apparatus 10 may determine 0 Lux as the minimum value of the illuminance values.

According to an embodiment, the electronic apparatus 10 may evenly divide the difference between the difference between the maximum value and the minimum value of illuminance values using the number of brightness change threshold values to be used. For instance, if there are two brightness change threshold values to be used, the electronic apparatus 10 may evenly divide the difference between the maximum value and the minimum value of illuminance values using 3 which is 2+1.

According to an embodiment, the electronic apparatus 10 may obtain a brightness change threshold value using an evenly-divided value. For instance, if there are two brightness change threshold values used by the electronic apparatus 10, 84 Lux, which is a value obtained by multiplying a value obtained by evenly diving the difference between the maximum value and the minimum value of the illuminance values by 1, can be determined as the first brightness change threshold value. In addition, the electronic apparatus 10 may determine 168 Lux, which is a value obtained by multiplying a value obtained by evenly dividing the difference between the maximum value and the minimum value of the illuminance values by 2, as the second brightness change threshold value.

According to an embodiment, the electronic apparatus 10 may update a look-up table matching a brightness change threshold value and the brightness of a display (e.g., the display 11 of FIG. 1) based on determined at least one brightness change threshold value. For instance, if the illuminance value obtained through a sensor (e.g., the sensor 12 of FIG. 1) is 0~84 Lux, the electronic apparatus 10 may change the brightness value of the display 11 to 400 nit. In addition, if the illuminance value obtained by the sensor 12 is 85~167 Lux, the electronic apparatus 10 may change the brightness value of the display 11 to 600 nit. Further, if the illuminance value obtained through the sensor 12 exceeds 168 Lux, the electronic apparatus 10 may change the brightness value of the display 11 to 700 nit.

Referring to FIG. 5-B of FIG. 5, the electronic apparatus 10 may derive the average value of the obtained illuminance values to 212 Lux (520). According to an embodiment, the electronic apparatus 10 may determine the average value of the illuminance values as the maximum value of the illuminance values. In addition, the electronic apparatus 10 may determine 0 Lux as the minimum value of the illuminance values According to an embodiment, the electronic apparatus 10 may evenly divide the difference between the difference between the maximum value and the minimum value of illuminance values using the number of brightness change threshold values to be used. For instance, if there are two brightness change threshold values to be used, the electronic apparatus 10 may evenly divide the difference between the maximum value and the minimum value of illuminance values using 3 which is 2+1.

According to an embodiment, the electronic apparatus 10 may obtain a brightness change threshold value using an evenly-divided value. For instance, if there are two brightness change threshold values used by the electronic apparatus 10, 70 Lux, which is a value obtained by multiplying a value obtained by evenly diving the difference between the maximum value and the minimum value of the illuminance values by 1, can be determined as the first brightness change threshold value. In addition, the electronic apparatus 10 may determine 141 Lux, which is a value obtained by multiplying a value obtained by evenly dividing the difference between the maximum value and the minimum value of the illuminance values by 2, as the second brightness change threshold value.

According to an embodiment, the electronic apparatus 10 may update a look-up table matching a brightness change threshold value and the brightness of a display (e.g., the display 11 of FIG. 1) based on determined at least one brightness change threshold value. For instance, if the illuminance value obtained through a sensor (e.g., the sensor 12 of FIG. 1) is 0~70 Lux, the electronic apparatus 10 may change the brightness value of the display 11 to 400 nit. In addition, if the illuminance value obtained by the sensor 12 is 71~140 Lux, the electronic apparatus 10 may change the brightness value of the display 11 to 600 nit. Further, if the illuminance value obtained through the sensor 12 exceeds 141 Lux, the electronic apparatus 10 may change the brightness value of the display 11 to 700 nit FIG. 6 is a view provided to explain a user interface for inputting a period for adjusting a brightness change threshold value provided by an electronic apparatus according to an embodiment.

According to an embodiment, when reaching a predetermined period, the electronic apparatus 10 may adjust the brightness change threshold value. For instance, the manufacturer of the electronic apparatus 10 may set a period for changing a brightness change threshold value in the electronic apparatus 10. Alternatively, the electronic apparatus 10 may provide a user interface for setting a period for adjusting a brightness change threshold value.

Figure 6:
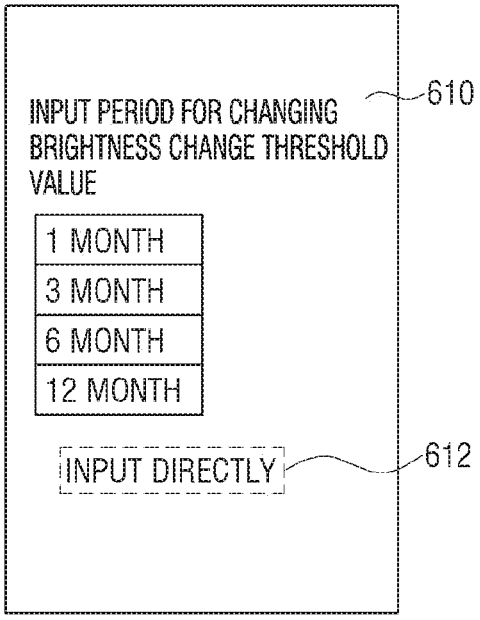
FIG. 6 is a view provided to explain a user interface for inputting a period for adjusting a brightness change threshold value provided by an electronic apparatus according to an embodiment.

Referring to FIG. 6, the electronic apparatus 10 may display a user interface 610 for inputting a period for changing a brightness change threshold value. For instance, the electronic apparatus 10 may determine a period for changing a brightness change threshold value in response to a user input that selects one of one month, three months, six months, and twelve months.

According to an embodiment, the electronic apparatus 10 may include an object 612 that allows a user to input a period for changing a brightness change threshold value in the user interface 610 and display the same. For instance, if a user selects the period input object 612, the electronic apparatus 10 may display a pop-up window for inputting a period. The pop-up window for inputting a period, for example, may be provided in a form such as a calendar in which a user may input a desired period. Alternatively, the pop-up window for inputting a period, for example, may be provided in a form in which a user selects numbers for inputting a desired period, but is not limited thereto.

According to the various embodiments, the user interface 610 for inputting a period for changing a brightness change threshold value may be displayed in another electronic apparatus. For instance, the electronic apparatus 10 may be in a state where communication with another apparatus (e.g., a smart phone, a tablet PC, etc.) has established. Another apparatus may receive information regarding the user interface 610 for inputting a period for changing a brightness change threshold value and display the same. In other words, the electronic apparatus 10 may be a common device such as a TV and another apparatus may be a personal device such as a smart phone and a tablet PC and in this circumstances, a user may easily set a period of changing a brightness change threshold value regarding the TV using the personal device such as a smart phone.

FIG. 7 is a view provided to explain a situation where an electronic apparatus displays a notification message informing that a brightness change threshold value has been adjusted according to an embodiment.

Referring to 7-A of FIG. 7, when the brightness of the display 11 is changed for the first time, the electronic apparatus 10 may display on the display 11 a notification message informing a user that the brightness of the display 11 has been changed using the adjusted brightness change threshold value.

Referring to 7-B of FIG. 7, another electronic apparatus 710 may display a notification message 730 informing that the brightness change threshold value of the electronic apparatus 10 has been adjusted. For instance, the electronic apparatus 10 may be in a state where communication with another electronic apparatus 710 has been established. Upon receiving a notification that the brightness change threshold value has been changed from the electronic apparatus 10, another electronic apparatus 710 may display the notification on a display 711. In other words, in a situation where the electronic apparatus 10 is a common device such as a TV and another apparatus 710 is a personal device such as a smart phone and a tablet PC, a user may be easily confirmed that the period of changing a brightness change threshold value regarding the TV has been adjusted using the personal device such as a smart phone.

Figure 8:
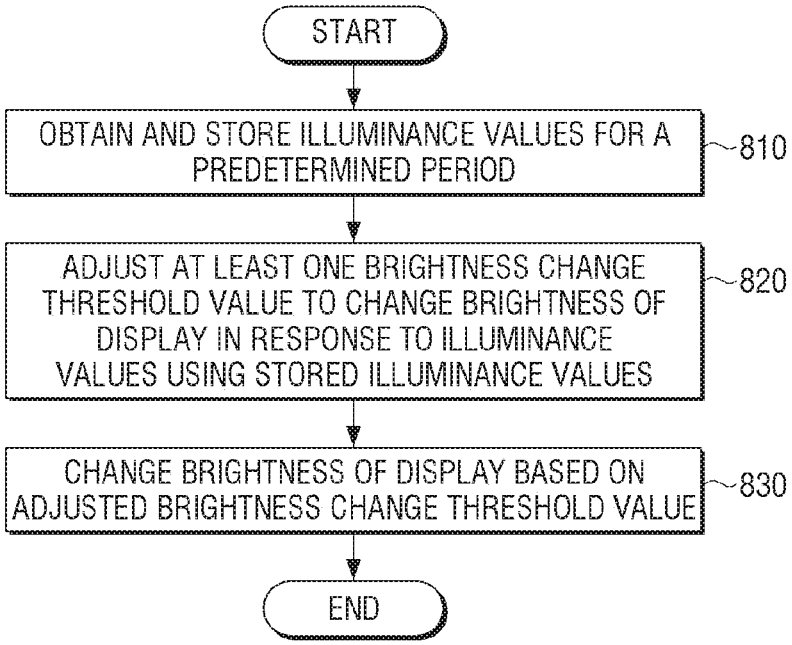
FIG. 8 is a flowchart provided to explain a situation where an electronic apparatus adjusts a brightness change threshold value, and changes the brightness of a display using the adjusted brightness change threshold value according to an embodiment.

FIG. 8 is a flowchart provided to explain a situation where an electronic apparatus adjusts a brightness change threshold value, and changes the brightness of a display using the adjusted brightness change threshold value according to an embodiment.

Referring to the step 810, the electronic apparatus 10 may obtain and store illuminance values for a predetermined period.

For instance, the electronic apparatus 10 may comprise a sensor for sensing light. The sensor, for example, may include an illuminance sensor. The sensor may obtain illuminance values by sensing the amount of light in the area where the electronic apparatus is located. The electronic apparatus 10 may obtain illuminance values for a predetermined period by controlling the sensor. The predetermined period, for example, may be a period (e.g., one month to three months or more) in which illuminance values enough to adjust the brightness change threshold value can be accumulated.

Referring to the step 820, the electronic apparatus 10 may adjust at least one brightness change threshold value to change the brightness of the display in response to illuminance values using the stored illuminance values.

For instance, the electronic apparatus 10 may obtain the frequency of illuminance values which are input for a predetermined period. The electronic apparatus 10 may determine an illuminance value equal to or greater than a certain reference value as the maximum illuminance value and determine 0 Lux as the minimum illuminance value. The electronic apparatus 10 may adjust a brightness change threshold value by dividing the difference between the maximum illuminance value and the minimum illuminance value by a value obtained by adding 1 to the number of brightness change threshold values. The electronic apparatus 10 may match the brightness change threshold values and the illuminance values and store the same in the form of look-up table.

Referring to the step 830, the electronic apparatus 10 may change the brightness of the display based on the adjusted brightness change threshold value.

For instance, the electronic apparatus 10 may change the brightness of the display by applying the obtained illuminance values obtained through the sensor to the look-up table where the adjusted brightness change threshold value is applied.

Figure 9:
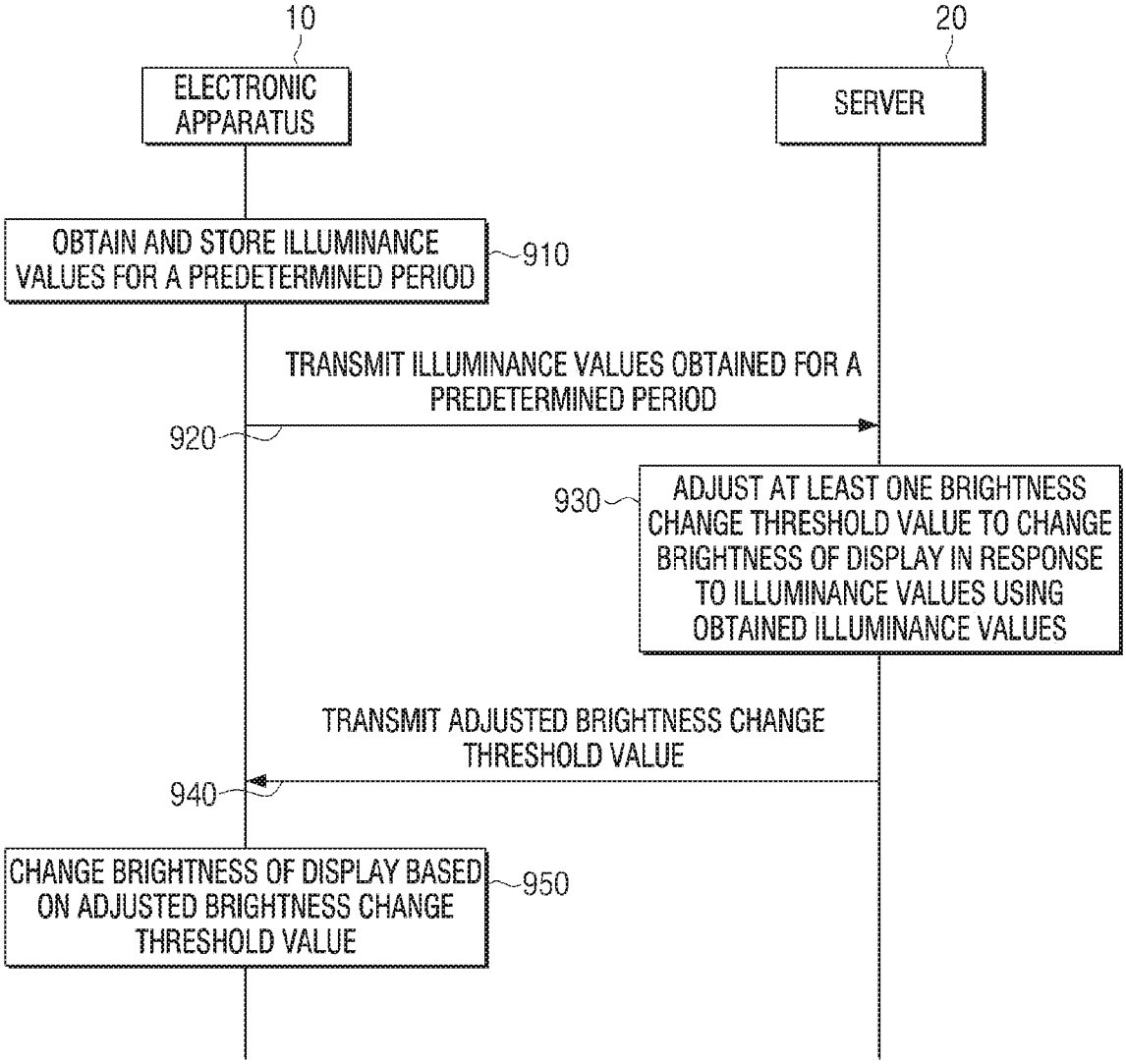
FIG. 9 is a flowchart provided to explain a situation where an electronic apparatus adjusts a brightness change threshold value in association with a server, and changes the brightness of a display using the adjusted brightness change threshold value according to an embodiment.

FIG. 9 is a flowchart provided to explain a situation where an electronic apparatus adjusts a brightness change threshold value in association with a server, and changes the brightness of a display using the adjusted brightness change threshold value according to an embodiment.

Referring to the step 910, the electronic apparatus 10 may obtain and store illuminance values for a predetermined period.

Referring to the step 920, the electronic apparatus 10 may transmit the illuminance values obtained for a predetermined period to the server 20.

Referring to the step 930, the server 20 may adjust at least one brightness change threshold value to change the brightness of the display in accordance with illuminance values using the obtained illuminance values.

For instance, the server 20 may obtain the frequency of the illuminance values which are input for a predetermined period. The electronic apparatus 10 may determine an illuminance value equal to or greater than a certain reference value as the maximum illuminance value and determine 0 Lux as the minimum illuminance value. The server 20 may adjust a brightness change threshold value by dividing the difference between the maximum illuminance value and the minimum illuminance value by a value obtained by adding 1 to the number of brightness change threshold values. The server 20 may match the brightness change threshold values and the illuminance values and store the same in the form of look-up table.

Referring to the step 940, the server 20 may transmit the adjusted brightness change threshold value to the electronic apparatus 10.

Referring to the step 950, the electronic apparatus 10 may adjust the brightness of the display based on the adjusted brightness change threshold value.

Figure 10:
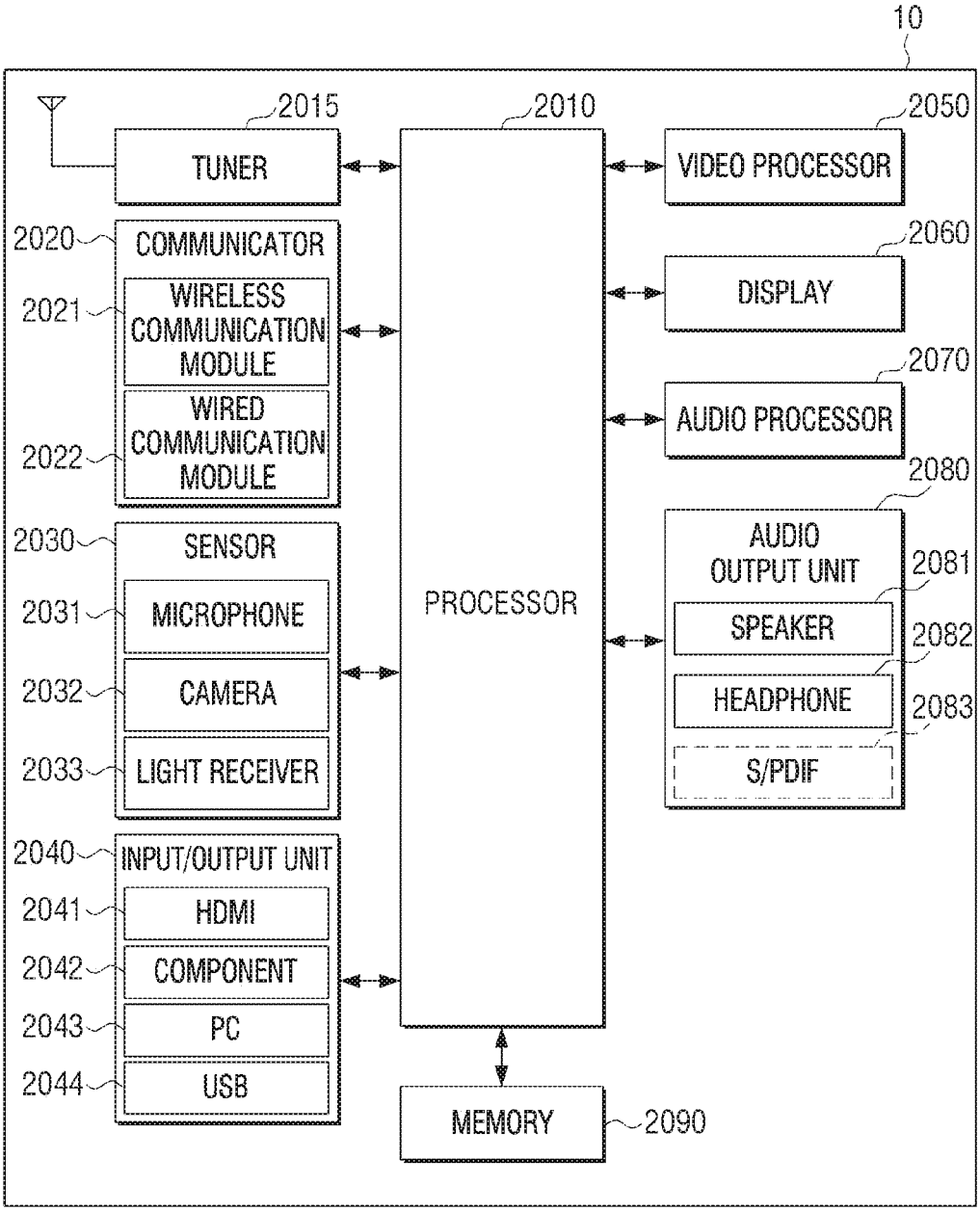
FIG. 10 is a block diagram of an electronic apparatus according to various embodiments.

FIG. 10 is a block diagram of an electronic apparatus according to various embodiments.

As illustrated in FIG. 10, the electronic apparatus 10 may further include at least one of a memory 2090, a tuner 2015, a sensor 2030, an input/output unit 340, a video processor 2050, an audio processor 2070, and an audio output unit 2080 other than a processor 2010, a communicator 2020 and a display 2060.

The processor 2010, the sensor 2030 and the display 2060 correspond to the processor 210, the sensor 220 and the display 240, respectively, and thus further description thereof will not be provided.

The processor 2010, for instance, may execute software (e.g., a program) stored in the memory 2090 to control at least one another component (e.g., hardware or software component) connected to the processor 2010, and perform various data processing or operation. According to an embodiment, as part of data processing or operation, the processor 2010 may load instructions or data received from another component onto the memory 2090 (e.g., a volatile memory), process the instructions or data stored in the memory 2090 and store the resulting data in a memory (e.g., a non-volatile memory). According to an embodiment, the processor 2010 may include a main processor (e.g., a central processing unit or an application processor) and an auxiliary processor (e.g., a graphic processing unit, an image signal processor, a sensor hub processor, or a communication processor) which can be operated independently or together with the main processor. Additionally or alternatively, the auxiliary processor may be configured to use less power than the main processor, or it may be set to fit a specific function. The auxiliary processor may be implemented separately from, or as a part of, the main processor. The auxiliary processor, for example, may control at least some of the functions or states related to at least one component of the components of the electronic apparatus 10 in replacement of the main processor while the main processor is in an inactive state (e.g., a sleep state) or together with the main processor while the main processor is in an active state (e.g., execution of an application).

The communicator 2020 may connect the electronic apparatus 10 with an external apparatus 20 and the server 20 under the control of the processor 2010. The communicator 2020 is operated independently from the processor 2010 (e.g., an application processor), and may include at least one communication processor which supports direct communication (e.g., wired communication) or wireless communication. According to an embodiment, the communicator 2020 may include a wireless communication module 2021 (e.g., a cellular communication module, a near-field wireless communication module or a global navigation satellite system (GNSS) communication module) or a wired communication module 2022 (e.g., a local area network (LAN) communication module or a power line communication module). The corresponding communication module from among the above communication modules may perform communication with the server 20 through the first network (e.g., a near-field communication network such as Bluetooth, WiFi direct or infrared data association (IrDA) or the second network (e.g., a wide area communication network such as LAN or WAN). These various types of communication modules may be integrated into one component (e.g., a single chip) or they may be implemented as a plurality of components (e.g., a plurality of chips).

The display 2060 may visually provide information (e.g., a UI) to the outside (e.g., a user) of the electronic apparatus 10. If the display 2060 is implemented as a touch screen forming a layer structure with a touch pad, the display 2060 may be used as an input apparatus as well as an output apparatus. The display 2060 may include at least one of a liquid crystal display, a thin film transistor-liquid crystal display, an organic light-emitting diode, a flexible display, a 3D display, and an electrophoretic display. Depending on the implementation of the electronic apparatus 10, the electronic apparatus 10 may include two or more displays 2060.

The tuner 2015 may tune and select only a frequency of a channel to be received by the electronic apparatus 10 among many electric wave components through amplification, mixing, resonance, etc. of a broadcast signal which is received via cable or wirelessly. The broadcast signal includes audio, video and additional information (e.g., Electronic Program Guide (EPG)).

The broadcast signal received through the tuner 2015 may be decoded (e.g., audio decoding, video decoding or additional information decoding) and divided into audio, video and/or additional information. The divided audio, video and/or additional information may be stored in the memory 2090 under the control of the processor 2010. There may be one or a plurality of tuners 2015 of the electronic apparatus 10. The tuner 2015 may be implemented as an all-in-one apparatus with the electronic apparatus 10, or may be implemented as a separate apparatus with a tuner unit which is electrically connected with the electronic apparatus 10 or as a tuner unit (not illustrated) which is connected to the input/output unit 2040.

The sensor 2030 may sense a user voice, a user image or a user interaction, and may include a microphone 2031, a camera 2032 and a light receiver 2033.

The microphone 2031 receives a user's utterance voice. The microphone 2031 may convert the received voice into an electric signal and output the same to the processor 2010. The camera 2032 may receive an image (e.g., continuous frames) corresponding to a user's motion including a gesture within a camera recognition range. The light receiver 2033 receives an optical signal (including a control signal) received from an external control device (e.g., a remote controller). The light receiver 2033 may receive an optical signal corresponding to a user input (e.g., touch, press, touch gesture, voice, or motion) from a control device. A control signal may be obtained from the received optical signal under the control of the processor 2010.

The input/output unit 2040 receives video (e.g., video, etc.), audio (e.g., voice, music, etc.) and addition information (e.g., EPG, etc.) from the outside of the electronic apparatus 10 under the control of the processor 2010. The input/output unit 2040 may include one of a High-Definition Multimedia Interface (HDMI) port 2041, a component jack 2042, a PC port 2043, and a USB port 2044. The input/output unit 2040 may include the combination of the HDMI port 2041, the component jack 2042, the PC port 2043, and the USB port 2044.

The video processor 2050 may process an image to be displayed by the display 2060, and may perform various image processing such as decoding, scaling, noise filtering, framerate conversion, resolution conversion, etc. with respect to video data.

The audio processor 2070 processes audio data. The audio processor 2070 may perform various processing such as decoding, amplification, noise filtering, etc. with respect to audio data.

The audio output unit 2080 may output audio included in a broadcast signal received through the tuner 2015, audio input through the communicator 2020 or the input/output unit 2040, or audio stored in the memory 2090 under the control of the processor 2010. The audio output unit 2080 may include at least one of a speaker 2081, a headphone output terminal 2082 and a Sony/Philips Digital Interface (S/PDIF) 2083.

The memory 2090 according to an embodiment may store a program for processing and controlling the processor 2010, and store data input to or output from the electronic apparatus 10.

The memory 2090 may include a storage medium in at least one of a flash memory type, a hard disk type, a multimedia card micro type, a card type memory (e.g., SD or XD memory, etc.), a Random Access Memory (RAM), a Static Random Access Memory (SRAM), a Read-Only Memory (ROM), an Electrically Erasable Programmable Read-Only Memory (EEPROM), a Programmable Read-Only Memory (PROM), a magnetic memory, a magnetic disk, and an optical disk.

The various embodiments of the present invention may be implemented as software (e.g., a program) including one or more instructions stored in a storage medium (e.g., the memory 2090) which can be read by machine (e.g., the electronic apparatus 10). For instance, a processor (e.g., the processor 2010) of the machine (e.g., the electronic apparatus 10) may call at least one instruction from among the stored one or more instructions from the storage medium and execute the instruction. This enables the machine to be operated to perform at least one function according to the called at least one instruction. The one or more instructions may include a code generated by a complier or a code that may be executed by an interpreter. The storage medium which can be read by machine may be provided in the form of a non-transitory storage medium. Here, 'non-transitory' merely means that the storage medium is a tangible device and does not include a signal (e.g., electromagnetic waves), and this term is not used to distinguish a case where data is stored in the storage medium semi-permanently and a case where data is stored temporarily.

A method according to the various embodiments may be included in a computer program product and provided therein. The computer program product can be traded between a seller and a buyer as a product. The computer program product may be distributed in the form of a storage medium that can be read by machine (e.g., compact disc read only memory (CD-ROM), or may be distributed online (e.g., downloaded or uploaded) through an application store (e.g., PlayStore™) or directly between two user devices. In the case of online distribution, at least a portion of the computer program product may be at least temporarily stored in a storage medium such as a memory of a server of a manufacturer, a server of an application store, or a relay server, or may be temporarily generated.

According to the various embodiments, each component (e.g., a module or a program) according to the above-described various embodiments may include a single entity or a plurality of entities, and some of the sub-components described above may be omitted or other sub-components may be further included in the various embodiments. Alternatively or additionally, some components (e.g., modules or programs) may be integrated into one entity to perform functions, which are performed by the components prior to the integration, in the same or similar manner. Operations performed by a module, a program, or another component according to various embodiments may be performed in a sequential, parallel, iterative, or heuristic manner, at least some of the operations may be executed in a different order or omitted, or other operations may be added.

What is claimed is:

1. An electronic apparatus comprising:

a sensor configured to sense an illuminance of an environment of the electronic apparatus;

a display;

at least one memory storing at least one instruction, and at least one processor, by executing the instruction, configured to:

obtain illuminance values for a predetermined period from the sensor, adjust at least one brightness change threshold value to change a brightness of the display in accordance with the obtained illuminance values for the predetermined period, change the brightness of the display using the adjusted at least one brightness change threshold value, and control the display to display a user interface for changing the predetermined period during which the illuminance values are obtained on the display.

2. The apparatus as claimed in claim 1, wherein the at least one processor obtains the illuminance values while outputting a content using the display.

3. The apparatus as claimed in claim 1, wherein the at least one processor obtains a maximum value of the illuminance values and a minimum value of the illuminance values using the obtained illuminance values, and adjusts the at least one brightness change threshold value using the maximum value of the illuminance values and the minimum value of the illuminance values.

4. The apparatus as claimed in claim 3, wherein the at least one processor obtains the maximum value of the illuminance values using illuminance values of which a frequency is equal to or greater than a predetermined value from among the obtained illuminance values.

5. The apparatus as claimed in claim 3, wherein the at least one processor obtains an average value of the obtained illuminance values and use the average value as the maximum value of the illuminance values.

6. The apparatus as claimed in claim 3, wherein the at least one processor evenly divides a difference between the maximum value of the illuminance values and the minimum value of the illuminance values by a value generated using a number of the at least one brightness change threshold values.

7. The apparatus as claimed in claim 1, wherein the at least one processor identifies that a location of the electronic apparatus is changed, and restarts a period for obtaining and storing the illuminance values when the location of the electronic apparatus is identified as being changed.

8. The apparatus as claimed in claim 1, wherein the at least one processor outputs a notification that the display is controlled using the adjusted at least one brightness change threshold value.

9. A controlling method of an electronic apparatus comprising:

obtaining illuminance values for a predetermined period;

adjusting at least one brightness change threshold value to change a brightness of a display in accordance with the obtained illuminance values for the predetermined period; and changing the brightness of the display using the adjusted at least one brightness change threshold value; and providing a user interface for changing the predetermined period during which the illuminance values are obtained.

10. The method as claimed in claim 9, the method further comprising:

obtaining the illuminance values while outputting a content using the display.

11. The method as claimed in claim 9, the method further comprising:

obtaining a maximum value of the illuminance values and a minimum value of the illuminance values using the obtained illuminance values, and adjusting the at least one brightness change threshold value using the maximum value of the illuminance values and the minimum value of the illuminance values.

12. The method as claimed in claim 11, the method further comprising:

obtaining the maximum value of the illuminance values using illuminance values of which a frequency is equal to or greater than a predetermined value from among the obtained illuminance values.

13. The method as claimed in claim 11, the method further comprising:

obtaining the maximum value of the illuminance values by obtaining an average value of the obtained illuminance values and using the average value as the maximum value of the illuminance values.

14. The method as claimed in claim 11, the method further comprising:

adjusting the at least one brightness change threshold value by evenly dividing a difference between the maximum value of the illuminance values and the minimum value of the illuminance values by a value generated using a number of the at least one brightness change threshold values.

15. The method as claimed in claim 9, the method further comprising:

identifying that a location of the electronic apparatus is changed, and re-starting a period for obtaining and storing the illuminance values when the location of the electronic apparatus is identified as being changed.

16. The method as claimed in claim 9, the method further comprising:

outputting a notification that the display is controlled using the adjusted at least one brightness change threshold value.

17. A computer program product including a non-transitory computer readable recording medium which stores instructions to perform operations of:

obtaining illuminance values for a predetermined period;

adjusting at least one brightness change threshold value to change a brightness of a display in accordance with the obtained illuminance values for the predetermined period;

changing the brightness of the display using the adjusted at least one brightness change threshold value; and providing a user interface for changing the predetermined period during which the illuminance values are obtained.

* * * * *